US007448306B2

(12) United States Patent
Shipman et al.

(10) Patent No.: US 7,448,306 B2
(45) Date of Patent: Nov. 11, 2008

(54) POINTING DEVICE INERTIAL ISOLATION AND ALIGNMENT MOUNTING SYSTEM

(75) Inventors: John M. Shipman, Albuquerque, NM (US); Eric T. Judkins, Albuquerque, NM (US); Glen Mantych, Placitas, NM (US); Daniel E. Burkholder, Maurepas, LA (US)

(73) Assignee: Honeywell International Inc., Morristown, NJ (US)

( * ) Notice: Subject to any disclaimer, the term of this patent is extended or adjusted under 35 U.S.C. 154(b) by 427 days.

(21) Appl. No.: 11/289,824

(22) Filed: Nov. 30, 2005

(65) Prior Publication Data

US 2006/0144216 A1 Jul. 6, 2006

Related U.S. Application Data

(60) Provisional application No. 60/638,244, filed on Dec. 21, 2004.

(51) Int. Cl.
*F41F 1/06* (2006.01)

(52) U.S. Cl. ..... 89/37.05; 89/37.14; 89/44.01

(58) Field of Classification Search ..... 89/37.03, 89/37.04, 37.05, 37.14, 40.02, 44.01, 44.02
See application file for complete search history.

(56) References Cited

U.S. PATENT DOCUMENTS 2,376,835 A * 5/1945 Trotter ..... 89/33.14
2,475,090 A * 7/1949 Green et al. ..... 89/44.01
2,701,963 A * 2/1955 Balleisen et al. ..... 73/167

FOREIGN PATENT DOCUMENTS

GB 2 167 539 A * 5/1986

* cited by examiner

*Primary Examiner*—Stephen M Johnson
(74) *Attorney, Agent, or Firm*—McDonnell Boehnen Hulbert & Berghoff LLP

(57) ABSTRACT

An isolation system for a sensitive component or apparatus affixed to a mortar tube comprising a barrel mount assembly which supports two parallel shafts. A plate parallel with each axis of the two shafts positions four bearing carrier blocks, two each containing a sleeve bearing which rides on each of the shafts to allow the plate assembly to slide freely along the length of the shafts and support an isolated cage. During firing, the travel vector is decoupled from the cage by the shafts as they move with the barrel through the bearings leaving the cage assembly in free space. The cage then accelerates under the force of gravity over the distance of the displaced travel of the shafts back to its rest position landing on steel springs or dampers, each on a shaft and seated against the lower flange end of the barrel mount assembly.

10 Claims, 7 Drawing Sheets

POINTING DEVICE INERTIAL ISOLATION AND ALIGNMENT MOUNTING SYSTEM

CROSS-REFERENCE TO RELATED APPLICATIONS

This application is based on U.S. Provisional Application Ser. No. 60/638,244 entitled "Pointing device inertial isolation and alignment mounting system." filed on Dec. 21, 2004, the teachings of which are incorporated herein by reference.

BACKGROUND OF THE INVENTION

1. Field of the Invention (Technical Field)

The present invention relates to mortars and more particularly to a method and apparatus for isolating a linear shock while maintaining the alignment of a sensitive electronic pointing device for use on a barrel of mortar or similar device.

2. Background Art

During the firing of a large bore weapon a significant reaction force is imparted to the barrel and support structure. A support structure, which is required to travel a certain distance before absorbing the load, allows the barrel and its attached components to undergo an instantaneous high-g acceleration. A sensitive electronic pointing device, such as inertial measurement unit or inertial navigation unit, and its attachment structure would be, and has been, destroyed by this extreme acceleration and deceleration.

The present invention is an inertial isolation method and apparatus of a pointing device from the mortar barrel recoil travel accomplished effectively through it's mounting assembly. For example, the Ring Laser Gyro (RLG) which is an integral part of Honeywell's Tactical Advanced Land Inertial Navigator (TALIN™) pointing device requires a mortar mount assembly designed to provide a stable and protective cage parallel to the center line of the barrel. The mortar barrel moves approximately twelve inches (12") under a high acceleration developing energy of approximately five hundred thousand foot pounds (500 k ft-lbs.) and then decelerates to a stop in less than 0.010 seconds when fired from a base plate in a free standing configuration. Most particularly, this mount needs to provide for the repeated firing of the mortar without realignment or mechanical adjustment while maintaining a zero ballistic force vector on the pointing device.

Presently the prior art PDMAs (pointing device mounting assembly) cannot withstand the recoil acceleration force while attached to a 120 mm mortar barrel when fired while mounted on a mortar weapon, such as the M9, base plate in the dismounted configuration. The present prior art PDMA experiences catastrophic failure of the steel mounting plates due to stress in excess of the bending moment of the material of their construction. This force exceeds the isolators travel limit and transfers the shock load into the RLG pointing device and causes internal physical damage.

The pointing device mounting assembly currently in use by the United States Army consists of two separate steel plates mounted to the mortar barrel with a pointing device cage suspended between them on an array of rubber isolators. This design provides a level of shock isolation for the pointing device only when fired from a non-recoiling platform (M-1064 vehicle mounted as opposed to free standing base plate). Problematic with the present design is the fact that plate alignment during attachment to the barrel is not easily indexed and this design cannot be used on the mortar barrel when fired from a base plate dismounted configuration due to the high gravity (g) load caused by the force of acceleration over the seating travel distance. This configuration has in the past bent and broken the steel plates and exceeded the shock isolation limits to the RLG pointing device.

Others have tried to solve the problem by designing a mounting platform for the RLG pointing device which combines the mortar barrel bi-pod support buffers in an assembly which attaches to the barrel and allows the mortar barrel to recoil while separating the RLG pointing device from recoil force through a shaft and bearing assembly on the bi-pod attachment collar.

The attempt in the prior art to design a mechanical force vector isolation system for the RLG pointing device fails to address the requirement for symmetry and even distribution of force throughout its design. The prior art design produces an unsupported moment arm which multiplies the recoil force vector rather than separating it. This causes the shaft and bearing assembly to seize and transfer the recoil force into the bi-pod attachment collar causing it to slip. The increased force applied to the offset design transmits a multiplied force into the RLG pointing device through the unsupported moment arm. The magnitude of the forces has caused the materials of construction in this prior art design to fail.

A prior art device is described in U.S. Pat. No. 4,336,917, which does not use guide rails and bearings for linear shock isolation and to maintain position alignment. It uses gas driven pistons and gas accumulator/controllers that are sensor-controlled to maintain position during shock and vibration. Another prior art device is described in U.S. Pat. No. 6,814,179, which also does not use guide rails and bearings for linear shock isolation and to maintain position alignment. It uses shock isolators that are comprised of rubber and polyurethane foam to absorb shock and vibration.

The present invention separates the sensitive electronic pointing device from the force vector during the specific impulse of firing by suspending it in inertial space while at the same time maintaining near perfect alignment with the bore axis of the barrel. This invention solves the problem of inertial isolation by providing a support structure which maintains the linear position of the shaft/bearing interface in a parallel plane with the axis of travel of the mortar barrel. The shaft/bearing support structure also distributes the firing loads evenly along the shaft during the recoil action and prevents the weight of the RLG pointing device from deflecting the shaft bearing assembly out of plane during the travel stage of the recoil.

SUMMARY OF THE INVENTION (DISCLOSURE OF THE INVENTION)

The present invention is a mechanical assembly designed to provide a linear travel support frame constructed of guide shafts aligned parallel with the barrel reactive force vector and suspending the mass of the pointing device on linear bearings that provide and maintain alignment while allowing the barrel and frame assembly to accelerate and decelerate without transfer of motion to the suspended pointing device. The pointing device then returns by gravitational force to its rest position on the mounting system. The parts work together to separate the acceleration vector of the mortar barrel from the TALIN™ mass. The barrel mount assembly moves the support shafts through the carrier bearings without imparting any acceleration to the supported structure containing the TALIN™.

A primary object of the present invention is to provide isolation of a linear force to minimize the effect of the force on a sensitive electronic device.

Another object of the present invention is to provide a repeatable and accurate positioning apparatus as well as the isolation as set forth above.

A primary advantage of the present invention is that it suspends the carrier along with the electronic device during a firing event thus, isolating the electronic device from any imparted linear shock.

Another advantage of the present invention is it is inexpensive to build and maintain.

Yet another advantage of the present invention is that it can be utilized for many different vehicle mounted and ground based free standing weapon systems.

Other objects, advantages, and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS (BEST MODES FOR CARRYING OUT THE INVENTION)

Figure 1:
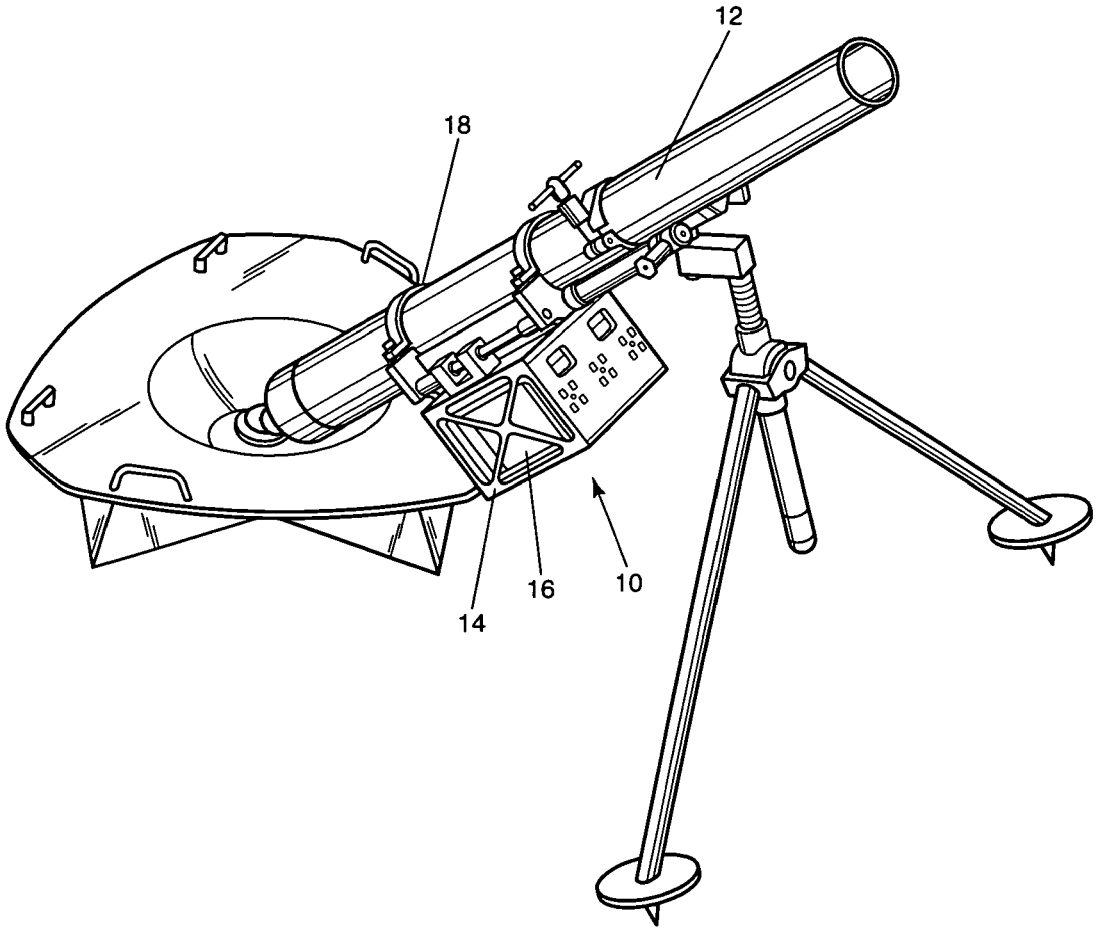
FIG. 1 is a perspective view of the preferred mounting structure mounted on a mortar.

Disclosed is the preferred embodiment of a mounting structure 10 for mounting a sensitive component such as a pointing device to a mortar, or the like. FIG. 1 shows a perspective view of mounting structure 10, affixed to a mortar tube or barrel 12. As can be seen, mounting structure 10 has a cage 14 to encase the pointing device 16, such as a TALIN™, and a clamping mechanism 18 to secure mounting structure 10 to mortar tube 12.

Figure 2:
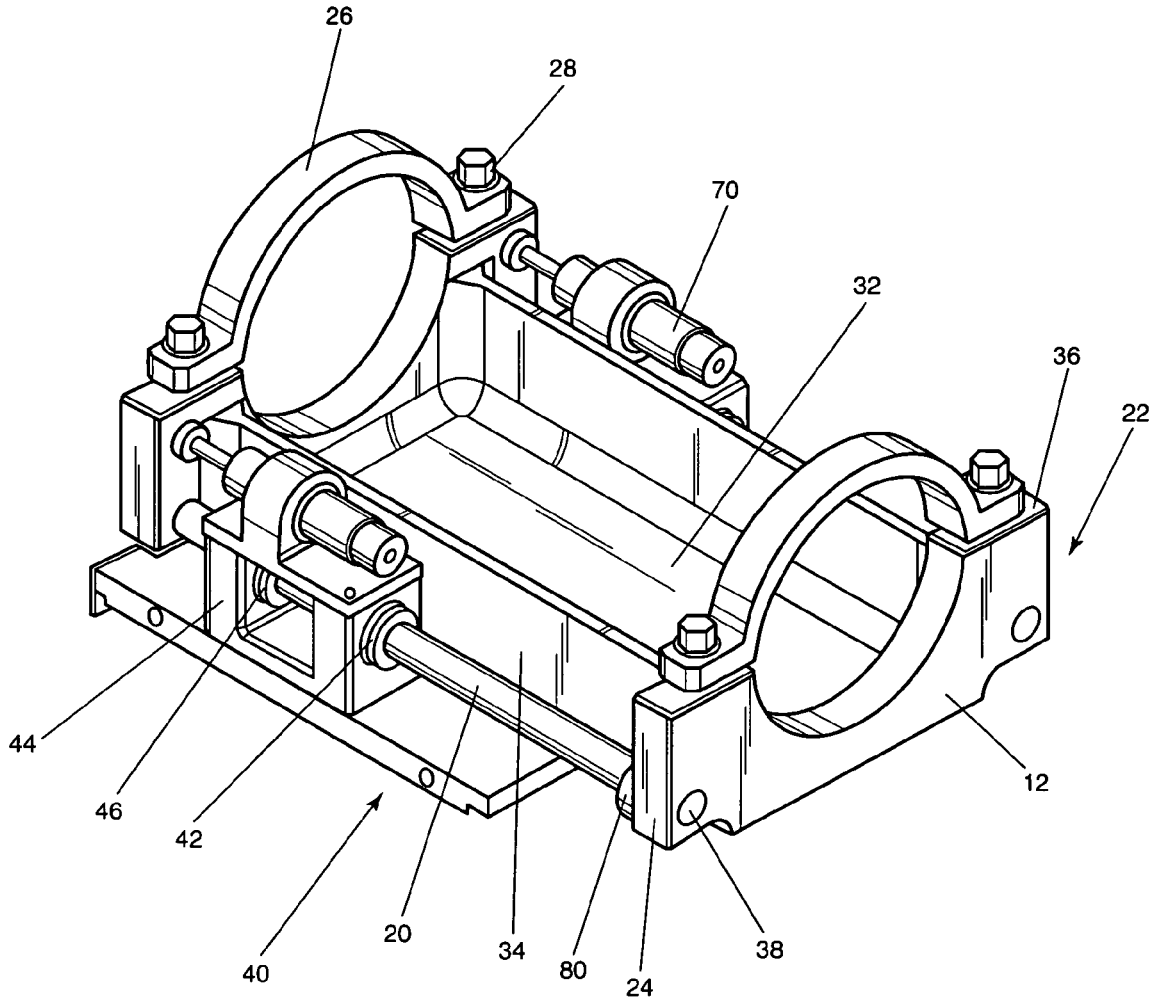
FIG. 2 is a perspective view of the mounting structure of FIG. 1.

FIG. 2 is a perspective top view of the preferred mounting structure. The first part of this embodiment is clamping mechanism 18 which mounts to mortar tube 12. Clamping mechanism 18 will anchor and position steel shafts 20 parallel to mortar tube 12. A typical mortar barrel 12 is a tube or a round pipe approximately five inches (5") in diameter and five feet (5') long. Steel shafts 20 are approximately twelve inches (12") long and need to be held perfectly parallel to the barrel 12 by clamping mechanism 18 comprising a saddle structure 22, and saddle clamps 26 with bolts 28. Saddle 22 has extensions 24 for receiving the ends of shafts 20, as shown. The alignment of mounting structure 10 needs to be held constant, therefore a rigid mechanical connection between two saddle clamps 26 needs to be designed into mounting structure 10 when mounted to barrel 12. In addition, saddle extensions 24 can be a separate mounting block permanently affixed to the lower portion of saddle structure 22 for holding shaft 20 ends, as shown. When considering the torsional stress applied by a bolt down force of more than ninety five (95+) foot pounds across the diagonal length of mounting structure 10, and the acceleration and firing shock of more than two thousand (2000) g's under which this barrel mounted structure is subjected to along with the temperature rise from repeated firings, additional structure to mounting structure 10 is needed to remain dimensionally stable. The preferred saddle structure 22 has saddle extensions 24 which are permanently affixed to base plate 32 and side members 34 forming a one piece "C" channel structure with lower portion of the saddle clamp 36 becoming a solid flange at each end of the channel which is drilled and tapped from its top side on each end to receive the upper saddle clamp 26 and bolts 28. This entire lower section of saddle structure 22 is preferably machined from a solid piece of bar stock 4340 steel to provide uniform strength and stress distribution throughout the structure. Saddle structure 22 can also be manufactured from aluminum, titanium, plastic, a composite or any other material that can withstand the forces exerted and the temperature rise of the barrel after several firings. Each upper portion saddle clamp 26 comprises a one piece semi circular shaped 4340 steel band with gusseted bolt eye extensions which fits over barrel 12 and bolts on both sides to the lower portion saddle clamp 36 as shown in FIG. 2. Shaft receiving apertures 38 in saddle extensions 24 are preferably align bored with a three quarters (¾") diameter+2/10ths (two ten thousandths) hole for receiving shaft 20 ends. The integrity of the mechanical connection between clamping mechanism 18 and the alignment of shafts 20 ensure that shafts 20 remain substantially parallel to mortar tube 12 for each firing. Additional holes can be cross drilled and tapped through each of shaft receiving apertures 38 to anchor the shaft 20 ends in place with an anchor bolt (not shown), or other well known means of anchoring can be used. Alternatively, each of the steel shafts 20 can be cross drilled parallel on each end to align with the saddle clamp bolts 28 to anchor steel shafts 20.

Figure 3:
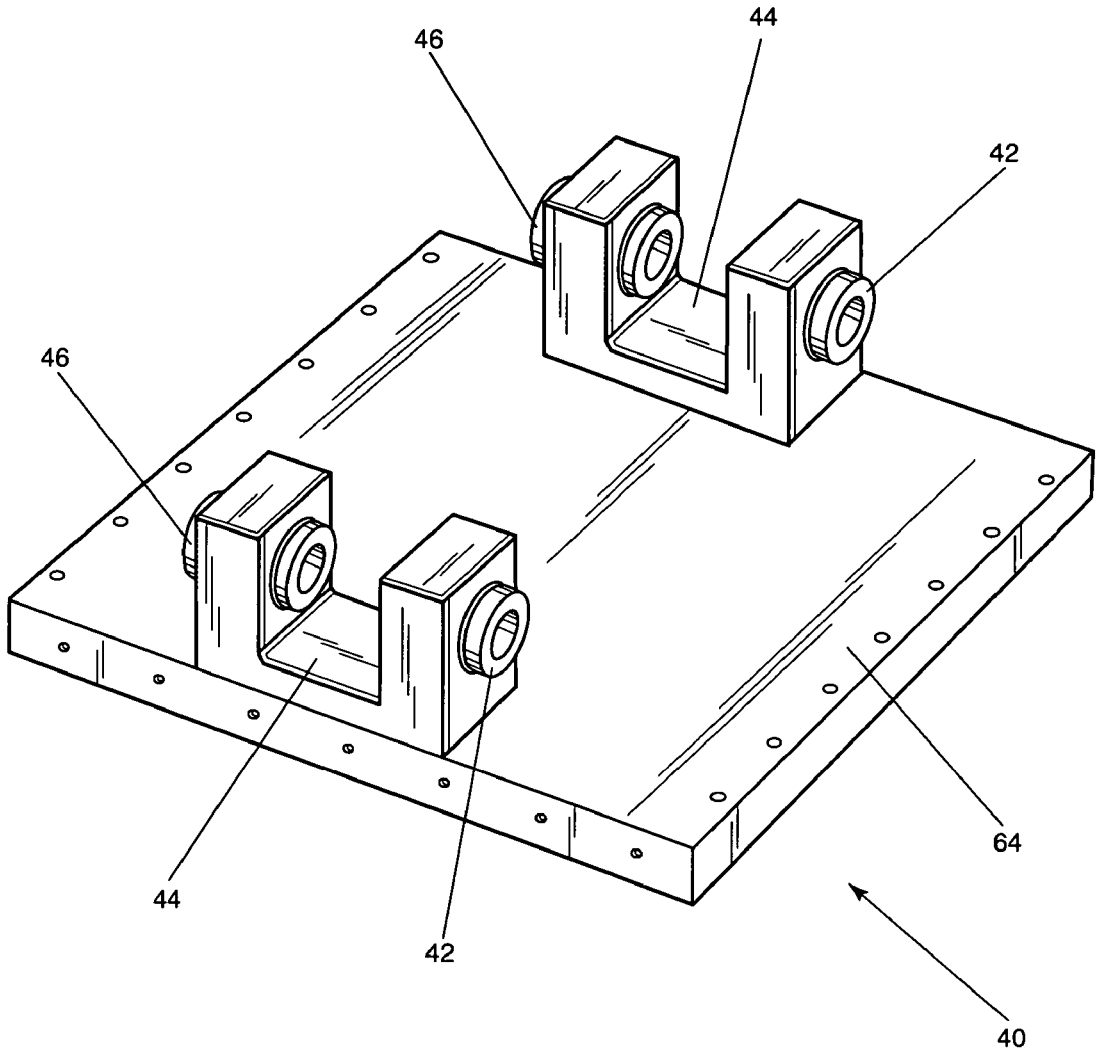
FIG. 3 is a perspective view of the preferred upper plate assembly.

FIG. 3 is a perspective view of the preferred upper plate assembly. Upper plate assembly 40 is the floating member for isolating the pointing device 16. Before steel shafts 20 can be inserted into the clamping mechanism assembly 18, sleeve bearings 42 and 46 must be correctly positioned on shafts 20. Sleeve bearings 42 and 46 are contained in a machined carrier block 44, which is dimensionally matched to the shaft receiving apertures 38 in clamping mechanism 18 and bolted in place. Machined carrier blocks 44 are permanently affixed to base plate 64. The preferred embodiment has two similar carrier blocks 44, each carrier block 44 in a "U" configuration with two legs as shown in the drawings. Each of the legs of carrier blocks 44 are configured to receive sleeve bearings 42 and 46. The forward sleeve bearing 42 is preferably a Teflon® coated self aligning design with a precision fit. The aft sleeve bearing 46 is a type made up of a series of ball bearings in a linear floating race arranged radially inside a cylindrical housing to act as a sleeve bearing. The combination of the two different types of bearing gives the present invention the ability to move freely on shafts 20 when barrel 12 is positioned at firing elevations while preventing un-restrained motion when returning to rest position facilitated by frictional damping of sleeve bearings 42.

Figure 4:
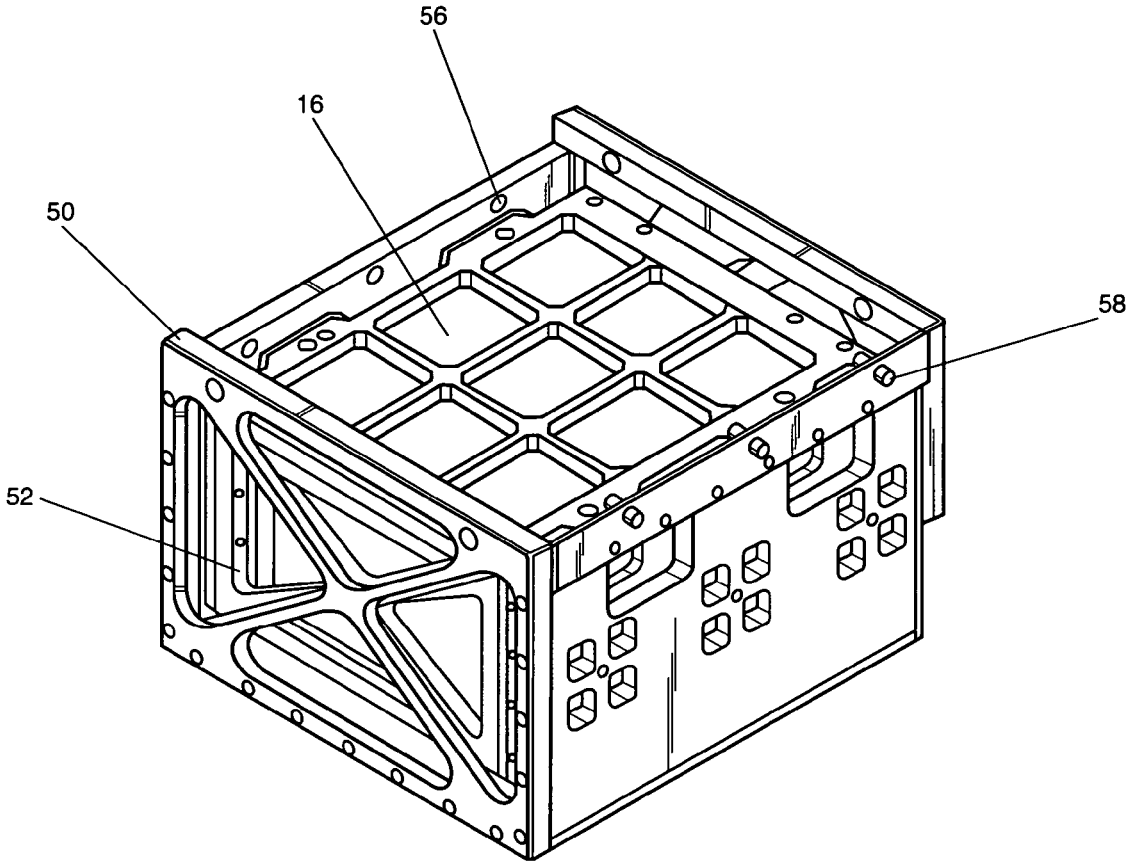
FIG. 4 shows the preferred cage assembly for encasing the pointing device.
Figure 5:
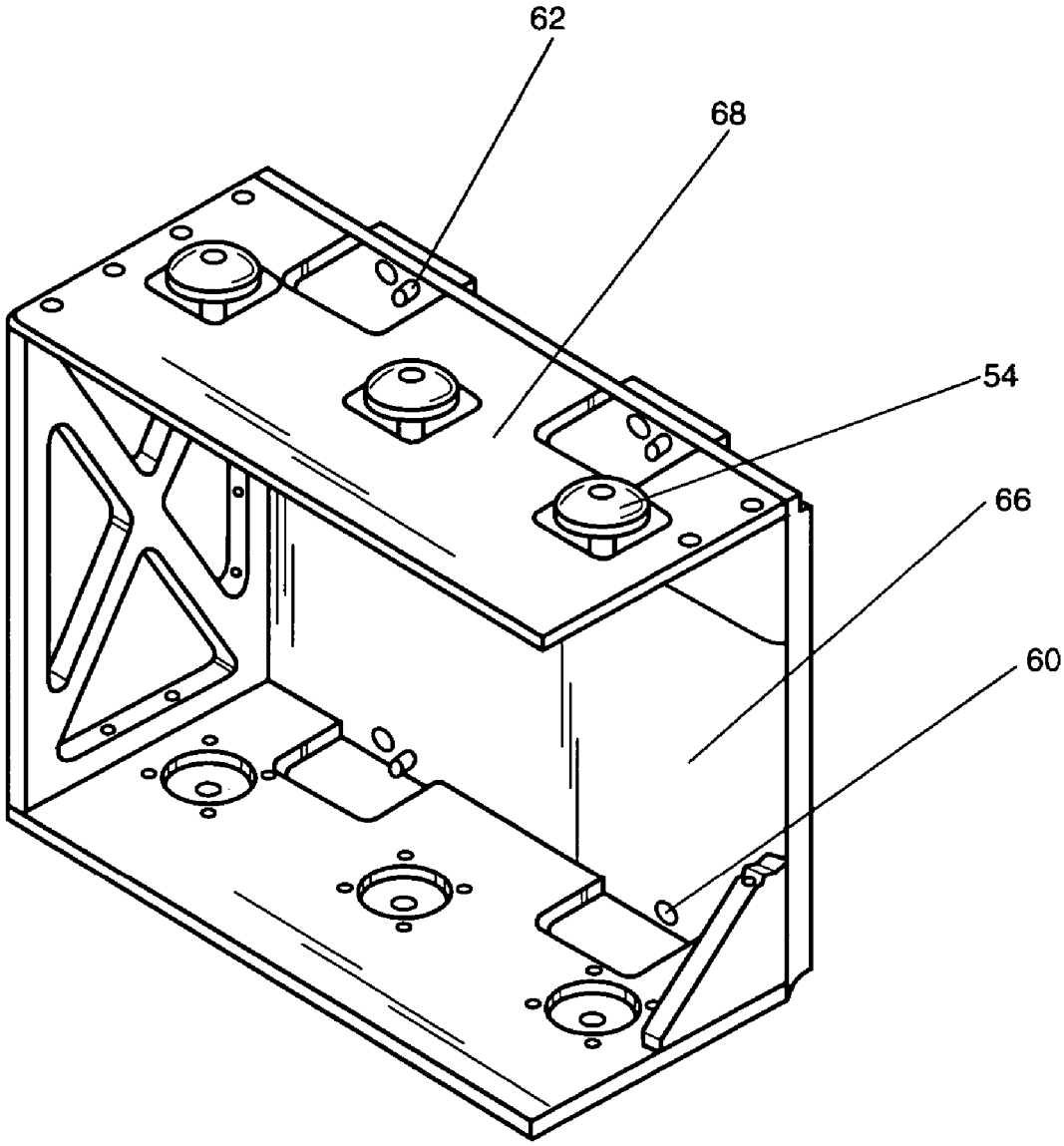
FIG. 5 shows the preferred inner case assembly.

FIG. 4 shows the preferred cage assembly 14 for encasing the pointing device. An outer cage 50 supports an inner cage 52, as shown. Using this configuration rubber isolators 54 can be attached to inner cage 52, as shown in FIG. 5 for cross-axis and secondary isolation of pointing device 16. In the preferred embodiment four rubber isolators 54, such as those manufactured by Lord Corp., are symmetrically mounted around the center of mass of inner cage 52 on the inside face of each end plate with 4 screws holding the base of each isolator to the end plate.

Pointing device 16 can be affixed to inner cage 52 using special mounts 60 and/or alignment pins 62. As shown in FIG. 4, in the preferred embodiment a quick release mechanism can be employed using quick release guide holes 56 and release pins 58 to engage and disengage outer cage 50 from base plate 64.

The inner cage assembly 52 mounts the pointing device 16 such as a TALIN™ through its feet with 4 bolts on the inner cage base plate 66. End plates of the inner cage 68 are bolted to inner cage base plate 66 along the edge in the direction of travel to form an open sided box. End plates of the inner cage 68 then attach to the travel end of each of the isolators 54 on the end of the outer cage 50.

Referring again to FIG. 2, springs or shock dampers 70 can be placed on the lower ends of the shafts 20 between the saddle extension 24 and the lower machined carrier block 44 or a side of the shaft as shown in FIG. 2. This allows for a reduced g load on the suspended cage assembly 14 as it returns to its rest position after a firing event. Additional springs or shock dampers 80 can be placed over shaft 20 between upper saddle extension 24 and upper machined carrier block 44 as a stop when the cage 14 reaches it's maximum movement range.

To begin operation of the mounting structure 10 it must first be mounted to mortar barrel 12. This is accomplished by positioning the unit on the underside of the mortar tube 12 and bolting the upper saddle clamps 26 to the saddle structure 22.

After starting clamp bolts 28 to secure mounting structure 10 in place, bolts 28 must be tightened to a predetermined torque limit and sequence, such as 95 Ft-Lbs. in a sequential pattern at 10 Ft-Lb. increments.

Figure 6:
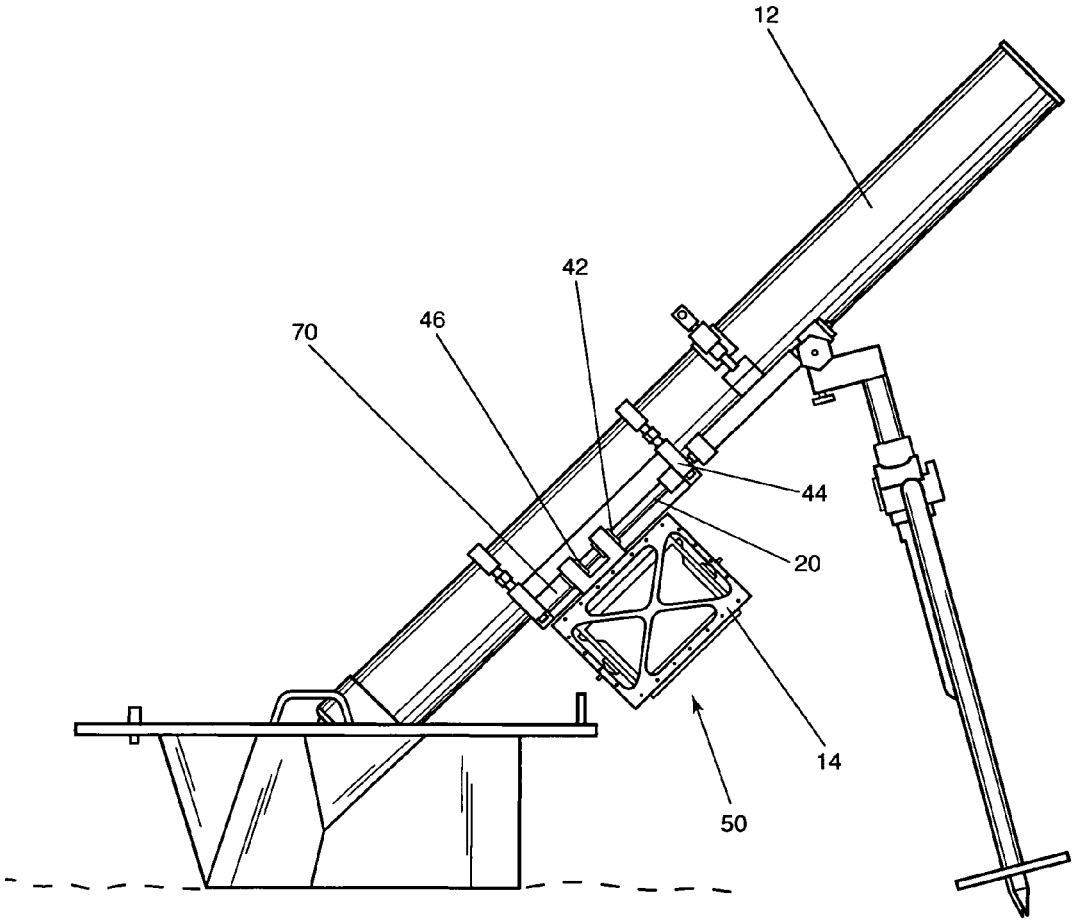
FIG. 6 shows the preferred mounting structure in the pre-fire condition.
Figure 7:
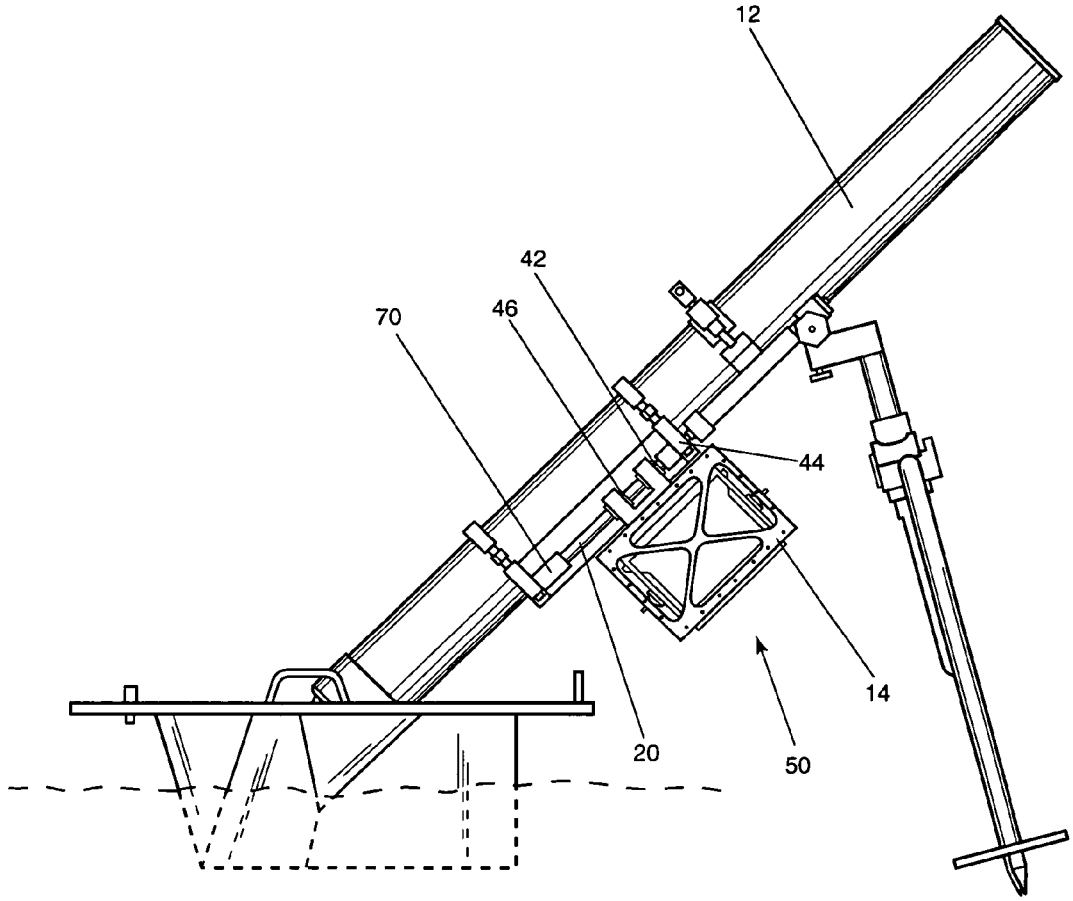
FIG. 7 shows the preferred mounting structure immediately after a firing condition.

At any given elevation, outer cage assembly 50 is resting on the lower return springs or shock dampers 70 as shown in FIG. 6. This is the ready to fire position. Referring to FIG. 7, during firing mortar tube 12 recoils in the direction of the breech cap to seat the base plate causing steel shafts 20 of mounting structure 10 to slide through the outer cage carrier blocks 44. At the end of the firing event mortar tube 12 comes to a stop leaving cage assembly 14 suspended by its bearings 42 and 46 at a point on steel shafts 20 equal to the distance the mortar barrel recoiled (traveled) during firing. The force of gravity causes cage assembly 14 to slide back down shafts 20 and come to rest on the lower springs or dampers 70 to the original ready to fire position. This operation is repeated over as many times as required by the firing of the mortar.

In operation, this preferred apparatus functions independently without any additional inputs or controls. During shutdown this device requires no change to its state.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above, are hereby incorporated by reference.

What is claimed is:

1. A mounting structure for aligning and isolating a shock of a sensitive component affixed to a mortar barrel, the mounting structure comprising:

a saddle apparatus for removeably affixing the mounting structure to the mortar barrel;

at least two guide shafts affixed to the saddle apparatus;

at least two carrier blocks affixed to an outer cage plate, said at least two carrier blocks comprising sleeve bearings for said at least two guide shafts;

shock dampers disposed at a lower end of each of said at least two guide shafts; and an inner cage affixed to an outer cage for encasing the sensitive component.

2. The mounting structure of claim 1 wherein said saddle apparatus comprises clamps.

3. The mounting structure of claim 1 wherein said at least two carrier blocks each comprises a U shaped member with each of said legs of said U shaped member configured to accept said sleeve bearings and one guide shaft of said at least two guide shafts.

4. The mounting structure of claim 3 wherein a first leg is configured to accept a self aligning sleeve bearing assembly and a second leg is configured to accept a sleeve ball bearing assembly.

5. The mounting structure of claim 1 wherein said at least two carrier blocks are integral with the outer cage plate.

6. The mounting structure of claim 1 wherein said at least two guide shafts are affixed to the saddle apparatus so that each of the guide shafts is substantially parallel to the mortar barrel.

7. The mounting structure of claim 1 wherein said shock dampers comprise springs.

8. The mounting apparatus of claim 1 further comprising shock dampers disposed at an upper end of each of said at least two guide shafts.

9. The mounting apparatus of claim 1 further comprising at least one isolator for isolating said inner cage from said outer cage.

10. The mounting apparatus of claim 1 further comprising a quick release mechanism for said outer cage.

* * * * *